US005363132A

United States Patent [19]

Ikkatai

[11] Patent Number: 5,363,132

[45] Date of Patent: Nov. 8, 1994

[54] COLOR INK JET PRINTING APPARATUS HAVING RETRACTABLE PRINTHEADS TO PREVENT NOZZLE CONTAMINATION

[75] Inventor: Masatoshi Ikkatai, Kawasaki, Japan

[73] Assignee: Canon Kabushiki Kaisha, Tokyo, Japan

[21] Appl. No.: 841,468

[22] Filed: Feb. 26, 1992

[30] Foreign Application Priority Data

Feb. 28, 1991 [JP] Japan ..... 3-057895

[51] Int. Cl.[5] ..... B41J 2/165

[52] U.S. Cl. ..... 349/8; 347/24; 347/29

[58] Field of Search ..... 346/140 R, 157, 46; 400/126

[56] References Cited

U.S. PATENT DOCUMENTS

| | | | |
|---|---|---|---|
| 3,817,365 | 6/1974 | Zimmermann . | |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,517,576 | 5/1985 | Sugawa | 346/46 X |
| 4,539,574 | 9/1985 | Broome et al. | 346/140 R X |
| 4,558,333 | 12/1985 | Sugitani et al. | 346/140 R |
| 4,646,111 | 2/1987 | Shimosato et al. | 346/140 R |
| 4,723,129 | 2/1988 | Endo et al. | 346/1.1 |
| 4,740,796 | 4/1988 | Endo et al. | 346/1.1 |
| 4,801,952 | 1/1989 | Nishikawa et al. | 346/140 R |
| 5,018,884 | 5/1991 | Hirano et al. | 400/126 |
| 5,103,244 | 4/1992 | Gast et al. | 346/140 R |
| 5,148,203 | 9/1992 | Hirano | 346/140 R |

FOREIGN PATENT DOCUMENTS

| | | |
|---|---|---|
| 0331481 | 9/1989 | European Pat. Off. . |
| 0376345 | 7/1990 | European Pat. Off. . |
| 54-056847 | 5/1979 | Japan . |
| 59-012864 | 1/1984 | Japan . |
| 59-123670 | 7/1984 | Japan . |
| 59-138461 | 8/1984 | Japan . |
| 60-071260 | 4/1985 | Japan . |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink jet apparatus for discharging a plurality of kinds of ink to a recording medium to thereby effect color recording has a plurality of recording head for discharging the inks to thereby effect recording, a carriage carrying the plurality of recording head thereon to be scanned along the recording medium, and forwardly and backwardly moving members for moving the plurality of recording heads carried on the carriage forwardly and backwardly independently of one another.

6 Claims, 4 Drawing Sheets

COLOR INK JET PRINTING APPARATUS HAVING RETRACTABLE PRINTHEADS TO PREVENT NOZZLE CONTAMINATION

BACKGROUND OF THE INVENTION

1. Field of the Invention

This invention relates to an ink jet apparatus for discharging ink from recording means to a recording medium to thereby effect recording, and particularly to an ink jet apparatus provided with a mechanism for achieving recording of higher quality.

2. Related Background Art

Recording apparatuses having the function of a printer, a copying machine, a facsimile apparatus or the like, or recording apparatuses used as compound machines including a computer and a word processor or the output apparatuses of work stations are designed such that a sheet-like recording medium such as paper or a plastic sheet is fed and conveyed and images are successively recorded on the recording medium on the basis of recording information. Such recording apparatuses can be grouped into the ink jet type, the wire dot type, the thermal type, the laser beam type, etc., depending on their recording systems.

Among them, the ink jet type (ink jet recording apparatus) is one which discharges ink from recording means (a recording head) to a recording medium to thereby effect recording, and has merits that it can record highly accurate images at a high speed, that it produces little noise because of it being a non-impact system and that inks of multiple colors can be used to record colored images easily. Also, as scanning systems for the recording means, use is usually made of a serial system using both of main scanning for moving the recording means along the recording medium and sub-scanning for moving the recording medium in the direction of conveyance, and the line system using recording means of the line type in which a number of discharge ports are arranged in the widthwise direction of paper and effecting only sub-scanning.

Particularly, as regards recording means (a recording head) of the ink jet type which utilizes heat energy to discharge ink, one having a liquid path arrangement (discharge port arrangement) of high density can be easily manufactured by forming an electro-thermal conversion member, an electrode, liquid path walls, a top plate, etc. made by filming on a substrate by way of the semiconductor manufacturing process including etching, vapor deposition, sputtering, etc. On the other hand, there are various requirements for the material of the recording medium, and in recent years, it has become required to use, besides paper and resin sheets (such as OHP) which are ordinary recording mediums, thin paper and worked paper (such as punched paper for filing, perforated paper and paper of any shape).

In the above-described ink jet recording apparatus, splashes of ink or the like are created when the ink is discharged from the recording head (recording means). Particularly, where a plurality of recording heads are used as during color recording, the quantity of splashes of ink is liable to become greater and the possibility of the splashes adhering to the surfaces of discharge ports, including the other recording heads is high, and the adherence of the splashes may deviate the directionality of discharged ink or the splashes adhering to said surfaces may be increased in viscosity to thereby clog the discharge ports, thus adversely affecting ink discharge and deteriorating the quality of images. Also, in some cases, under the influence of the adhering splashes, foreign materials such as paper powder and dust may adhere to said surfaces of the discharge ports and again in such cases, ink discharge is adversely affected. So, cap means for covering the surfaces of the recording heads during the non-use of the heads is provided with a view to continuously effect good recording, or a cleaning member such as a blade is provided to wipe off ink or foreign materials such as dust adhering to the surfaces of the discharge ports of the recording heads.

Now, ink jet apparatuses include apparatuses in which a plurality of recording heads (yellow, cyan, magenta and black) are provided to enable full color recording to be accomplished as previously described. In such apparatuses, full color recording is usually effected, but in some cases, recording using only a predetermined color (e.g. black) is effected.

Even in such a case, the recording heads which do not contribute to recording are also scanned because the plurality of recording heads are usually carried on a common carriage.

Thus, due to such scanning, splashes of ink may adhere to the surfaces of the recording heads which do not contribute to recording or foreign materials such as dust and paper powder may adhere to said surfaces.

The recording heads to which foreign materials adhere may in some cases exhibit the deterioration of their ink discharging performance as previously described and therefore, they are cleaned by a cleaning member or the like. The cleaning of the recording heads which are not used for recording may result in the peeling of the water repelling agent, the movement of unnecessary materials from the cleaning member, etc, and thus will affect the recording heads in one way or another.

Accordingly, it is preferable to design the recording heads such that only the recording head being used is cleaned. It is also preferable that only the head used be scanned. However, the head used entirely differs depending on recorded images and therefore, the design for only the recording head used to be scanned independently is very complicated and cannot be achieved unless difficult control is resorted to.

In researching to solve the above-noted problems it has been found that if during the recording scan of the carriage on which the recording heads are carried, those of the recording heads which are not used in the recording of that one line are retracted so as to be spaced apart from the recording position, it is difficult for splashes of ink to adhere to the surfaces of those heads.

The present invention has been made on the basis of this finding.

Also, the present invention will suffice if it achieves the technical idea of retracting the recording heads from an area in which ink are liable to adhere to the surfaces of the heads during recording are floating, or preventing ink droplets from adhering to the surfaces of the recording heads or making it difficult for ink droplets to adhere to the surfaces of the recording heads, by some other technique.

This technical idea can be achieved not only by the design for retracting the unnecessary recording heads from the recording station during recording scan, but also by a design for retracting all heads during return.

Also, a cover may be provided over the surfaces of the recording heads which are not used for recording.

Of course, such covering may be done at the recording position of the recording heads, but when it is taken into account that the spacing between the surfaces of the heads and the recording medium is very small, the covering may preferably be done after the recording heads which are not used for recording are retracted to provide a predetermined or greater spacing so that the cover may not contact with the recording medium, whereby there can be provided a reliable and safe cover which will not adversely affect the recording medium.

By adopting such a design for making it difficult for ink droplets to adhere to the surfaces of the recording heads, the frequency of the contact of the cleaning member with the recording heads can be decreased and the water repelling agent of the surfaces of the heads can be prevented from peeling and/or the surfaces of the heads can be prevented from being harmed.

SUMMARY OF THE INVENTION

The present invention has been made on the basis of such findings and an object thereof is to provide an ink jet recording apparatus in which the adherence of ink, paper powder, etc. to the discharge port surfaces of recording heads can be prevented and the influence of the contact of a wiper member or the like with the discharge port surfaces can be eliminated to the utmost and moreover the amount of ink consumed for idle discharge effected for the recovery of discharge can be saved.

Another object of the present invention is to provide an ink jet apparatus for discharging a plurality of kinds of ink to a recording medium to thereby effect color recording, which is provided with a plurality of recording means for discharging the ink to thereby effect recording, a carriage carrying said plurality of recording means thereon and scanned along said recording medium, and a forwardly and backwardly moving member for moving said plurality of recording means carried on said carriage forwardly and backwardly independently of one another.

Still another object of the present invention is to provide an ink jet apparatus for discharging a plurality of kinds of ink to a recording medium to thereby effect color recording, which is provided with a plurality of recording means for discharging the ink to thereby effect recording, a cap member for individually covering the ink discharge surface of each of said plurality of recording means, and drive control means for selecting those of said recording means which are not used, by a recording signal input for the recording of each one line, and driving and controlling said cap member so as to cover said selected recording means.

DESCRIPTION OF THE PREFERRED EMBODIMENTS

Figure 1:
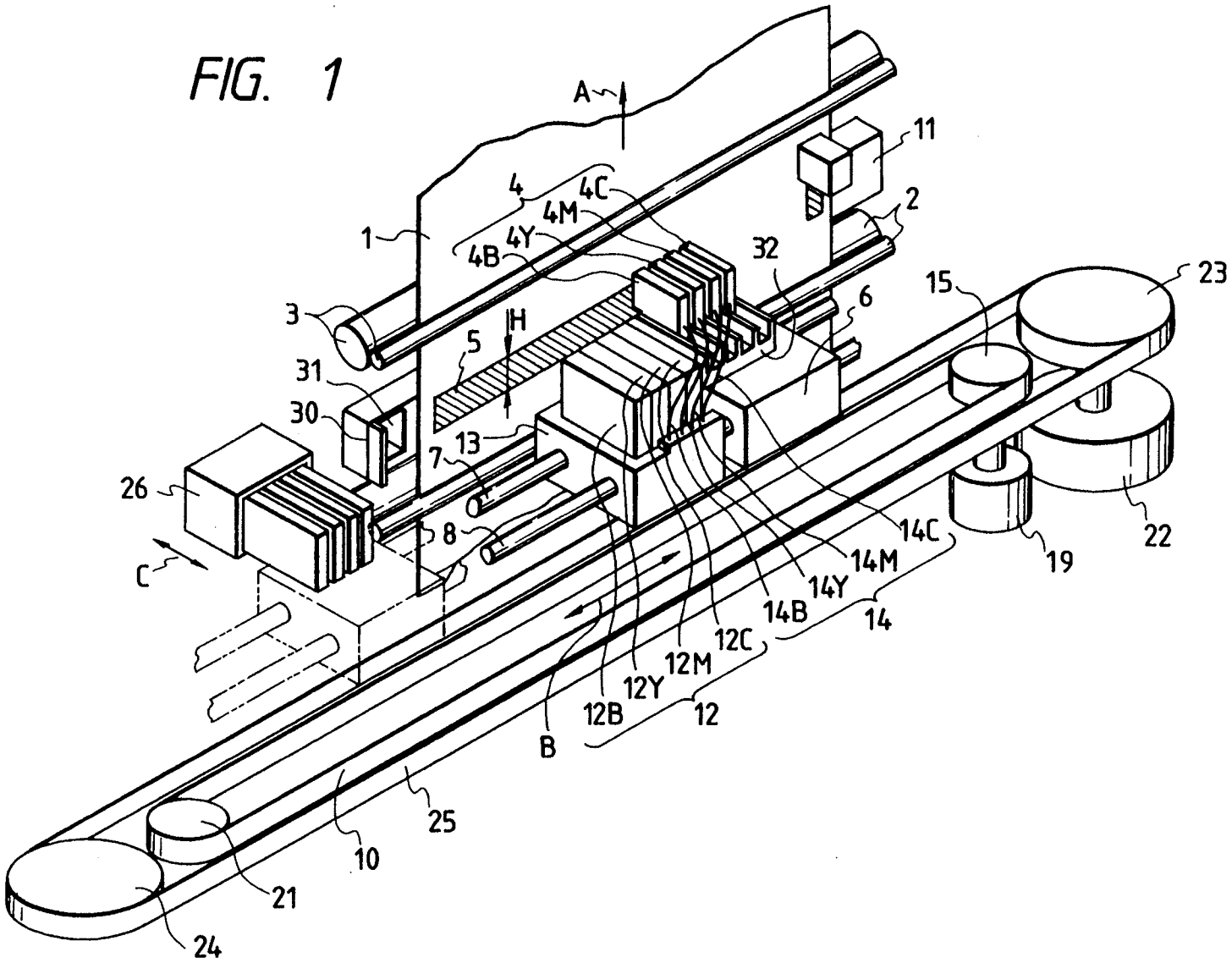
FIG. 1 is a perspective view showing the construction of/the essential portions of an embodiment of an ink jet apparatus to which the present invention is applied.

Some embodiments of the present invention will hereinafter be described with reference to the drawings. FIG. 1 is a perspective view showing the construction of an embodiment of an ink jet recording apparatus to which the present invention is applied. In FIG. 1, a recording medium 1 in the form of a roll or a cut sheet is conveyed to a tension roller 3 (a high accuracy roller) 3 comprising a pair of rollers by a conveying roller 2 comprising a pair of rollers, whereafter it is stopped from being conveyed and is set at a recording start position, and then the main scanning of recording means (recording heads) 4 is started, and the recording means 4 is driven on the basis of an image signal, whereby an image 5 of a predetermined width H is recorded on the recording medium 1. The recording means 4 is carried on a carriage 6 reciprocally movable along the recording medium 1. That is, the carriage 6 is guided and supported on two guide rails 7 and 8 installed in parallelism to the recording surface of the recording medium 1 and is connected to a belt 10 reciprocally driven by a motor 19 and accordingly, the recording means 4 has its movement and position controlled in the main scanning direction by the drive control of the motor 19.

A platen 11 for position-regulating the recording surface of the recording medium relative to the recording heads 4 is installed at a position opposed to the recording heads 4.

This platen 11 is formed with a platen surface (a supporting surface) for supporting the back of the recording medium 1, and this platen surface is constituted by a surface for positively contacting with and holding the recording medium as by electrostatic attraction or air suction, but in some cases, it may be constituted by only an ordinary flat surface.

The recording means (recording heads) 4 mounted on the carriage 6 is constituted by four recording means (recording heads) 4C, 4M, 4Y and 4B using different kinds of ink, respectively. In the case of color recording, for example, cyan, magenta, yellow and black are used as the colors of the ink used by these recording heads 4C, 4M, 4Y and 4B. In the following description, when any one or all of the recording means 4C, 4M, 4Y and 4B are referred to, it or they are simply designated by the recording means 4 or the recording head 4. In the present embodiment, each recording head ( recording means ) 4 is mounted independently for forward and backward movement relative to the carriage 6, through its respective housing 32.

The recording means (recording heads) 4 is provided with an electro-thermal conversion member generating heat energy utilized to discharge ink. Also, the recording means 4 discharges ink from the discharge ports on the basis of a change in the state of the ink including the production of bubbles by film boiling created in the ink by the heat energy generated by the electro-thermal conversion member.

Figure 2:
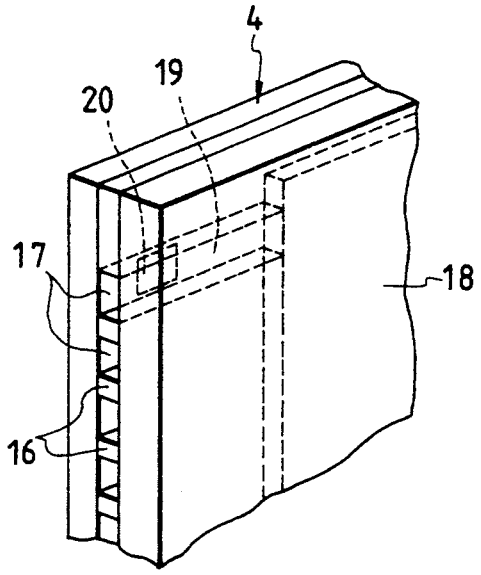
FIG. 2 is a fragmentary perspective view shcematically showing the structure of the ink discharge portion of recording means shown in FIG. 1.

FIG. 2 is a fragmentary perspective view schematically showing the structure of the ink discharge portion of the recording means (recording head) 4. In a discharge port surface 16 facing the recording medium 1 with a predetermined clearance (e.g. about 0.5–1.5 mm, and indicated by a symbol F in FIG. 4) interposed therebetween, there are formed a plurality of discharge ports 17 at a predetermined pitch, and an electro-thermal conversion member (such as a heat generating resistance member) 20 for generating ink discharging energy is disposed along the wall surface of each ink path 19 communicating a common liquid chamber 18 with each discharge port 17. In the ink jet recording apparatus of FIG. 1, each recording means (recording head) 4 is carried on the carriage 6 in such positional relationship that the plurality of discharge ports 17 are arranged in a direction intersecting the main scanning direction (the direction of movement) of the carriage 6. Thus, there is constructed the recording means (recording head) 4 in which the corresponding electro-thermal conversion member 20 is driven (electrically energized) on the basis of an image signal or a discharge signal to cause the film boiling of the ink in the ink path 19 and the ink is discharged from the discharge ports 17 by pressure created at that time.

In FIG. 1, an ink tank (for example, an ink cartridge) 12 for supplying the ink to the recording means 4 is carried on another carriage 13 movable in the main scanning direction in synchronism with the carriage 6. This ink tank 12 is constituted by four ink tanks 12C, 12M, 12Y and 12B corresponding to the four recording means 4, and these ink tanks contain cyan ink, magenta ink, yellow ink and black ink, respectively, therein. The inks in these ink tanks 12C, 12M, 12Y and 12B are supplied to the recording means 4C, 4M, 4Y and 4B, respectively, by a pump, not shown, through tubes, 14C, 14M, 14Y and 14B, respectively. Again in the following description, when any one or all of the ink tanks 12C, 12M, 12Y, 12B and the tubes 14C, 14M, 14Y, 14B are referred to, it or they are simply designated by the ink tank 12 and the tube 14.

In FIG. 1, the carriage 6 for the recording means 4 is reciprocally driven in the direction of arrow B by the motor 19 through a driving pulley 15, a driven pulley 21 and the belt 10. The motor 19 is for regulating the main scanning of the recording means 4 (the widthwise recording position of the recording medium), and is drive-controlled with high accuracy. Also, the carriage 13 for the ink tank 12 is reciprocally driven in the direction of arrow B by a motor 22 through a driving pulley 23, a driven pulley 24 and a belt 25, in synchronism with the carriage 6 for the recording means. In the present embodiment, the ink tank 12 is made movable in the main scanning direction with the recording means 4, whereby any stress applied to the ink supply tubes 14 is eliminated, and the carriage 6 for the recording means 4 and the carriage 13 for the ink tank 12 are driven discretely from each other, whereby vibration or the like created by the movement of the ink tank which is relatively heavy is prevented from being propagated to the recording means 4 side.

The conveying roller 2 and the tension roller 3 are driven in synchronism with each other by motors, not shown. In order to impart proper tension to the recording medium 1 in the recording station and ensure a degree of planarity in that case, the tension roller 3 is designed to be rotated at a peripheral. velocity somewhat higher than that of the conveying roller 2. Also, the tension roller 3 is for accurately feeding the recording medium 1 to the recording means 4, and the rotation thereof is controlled precisely.

Within the range of movement of the recording means 4 and outside the range of the supporting surface of the platen 11 (outside the left recording area of the platen 11 in FIG. 1), there are disposed a-wiper member 30 for cleaning the discharge port surface 16 of the recording means 4 and a recess 31 for receiving the ink idly discharged from the discharge ports 17 of the recording means 4. The wiper member 30 is designed to bear against the discharge port surface 16 of the recording means 4 and wipe off any ink, paper powder and/or dust adhering to the discharge port surface 16, i.e., adhering matters hampering normal ink discharge, by the utilization of the movement of the carriage 6. Also, in the shown embodiment, one and the same wiper member 30 is brought into contact with the four recording means 4 and therefore, the inks near the discharge ports of the respective recording means may be mixed with one another. So, the operation of discharging and discarding any inks that may be mixed with one another from the discharge ports 17 of the recording means 4 (idle discharge) is performed at predetermined timing (as before recording). The aforementioned recess 31 is for receiving the inks thus idly discharged.

Also, a cap 26 for hermetically sealing the discharge port surface 16 of each recording head 4 is disposed at a position further left of the wiper member 30, i.e., a position at which the carriage 6 and recording means (recording heads) 4 are opposed to the wiper member when they come to the left end portion indicated by dots-and-dash lines (the home position). This cap 26 is movable in the longitudinal direction of the apparatus (the direction of arrow C) , and when the recording heads 4 come to the home position and enter into their waiting state, the cap 26 is driven forward to a position for hermetically sealing the discharge port surface 16 of each recording head 4, by a motor, not shown, and when a recording command is given again, the cap 16 is retracted to a position spaced apart from the discharge port surface 16.

So, recording by the recording means 4 is started on the stopped recording medium 1 from the left side as viewed in FIG. 1, and image recording 5 of a recording width H is effected to the right side and thus, the recording of one line is terminated. When the recording of one line is terminated, the carriages 6 and 13 are returned to their left predetermined positions (carriage return). During this return movement of the carriages 6 and 13, the conveying roller 2 and the tension roller 3 are driven by a predetermined amount, whereby the recording medium 1 is fed by a predetermined amount (usually, an amount corresponding to the width H of one line) in the direction of arrow A (the conveyance direction). After the conveying roller 2 and the tension roller 3 are stopped to terminate the paper feeding, the recording of the next line is started. Thereafter, a similar recording operation is repeated to thereby effect recording on the whole area of the recording medium 1. When the recording is terminated, the recording medium 1 is discharged out of the apparatus by a discharge roller, not shown.

Figure 3:
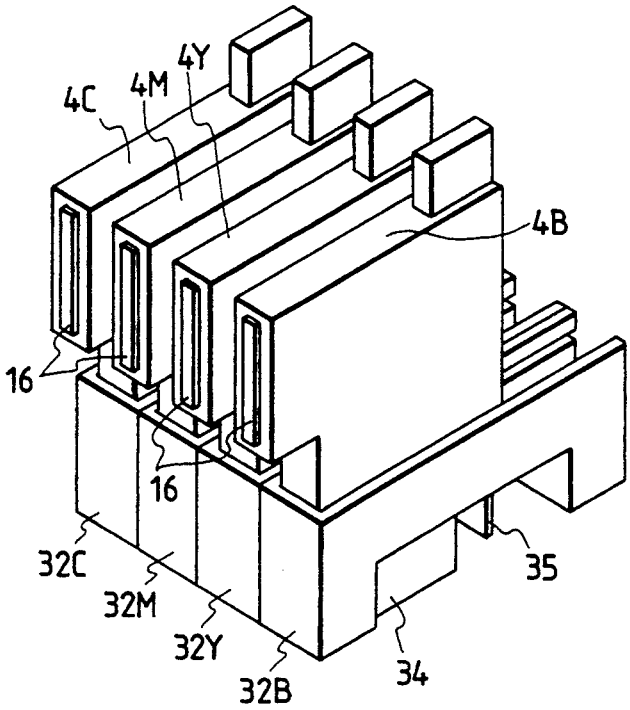
FIG. 3 is a fragmentary enlarged perspective view of the recording means and head housing shown in FIG. 1 as they are seen from the discharge port surface side.

FIG. 3 is a fragmentary enlarged perspective view showing the plurality of recording heads 4 on the carriage 6. In FIG. 3, the recording heads 4 are carried on the carriage 6 through their respective housings 32. That is, four head housings 32C, 32M, 32Y and 32B are fixed on the carriage 6, and the recording heads 4C, 4M, 4Y and 4B are carried on the head housings 32C, 32M, 32Y and 32B, respectively. In the following description, when referring to any one or all of these head housings 32C, 32M, 32Y and 32B, it or they are simply designated by the head housing 32.

Figure 4:
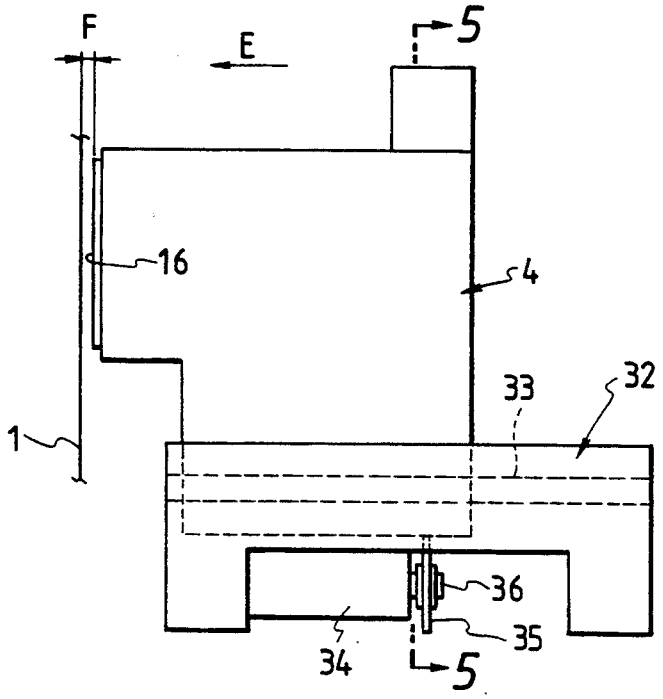
FIG. 4 is a side view of the recording means and head housing of FIG. 3 is a recording possible state.
Figure 5:
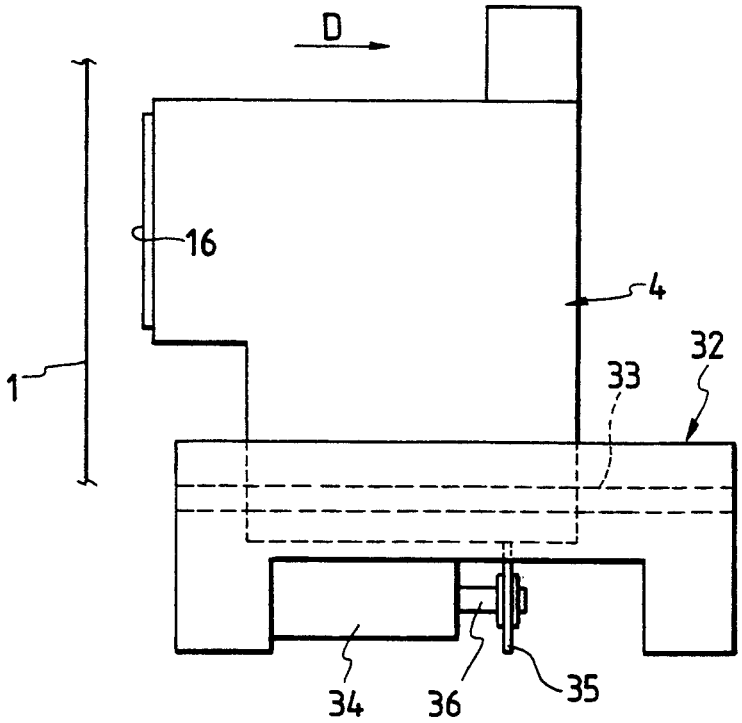
FIG. 5 is a side view of the recording means and head housing of FIG. 3 when the recording means are retracted.

FIG. 4 is a side view of any one recording head 4 and its head housing 32 shown in FIG. 3, and FIG. 5 is a side view showing a state in which the recording head is retracted from the state of FIG. 4 in which recording is possible. In FIGS. 3 to 5, each recording head 4 is carried on the head housing 32 for movement from the state of FIG. 4 in which recording is possible to the state of FIG. 5 in which the recording head is retracted away from the recording medium 1. That is, each recording head 4 is carried on the head housing 32 for sliding back and forth by a longitudinal guide groove 33, and driving means such as a solenoid 34 is mounted on each head housing 32, and the movable portion 36 of each driving means (solenoid) 35 is coupled to a protruding portion 35 provided integrally with each recording head 4. Thus, each recording head 4 is carried in such a manner that the position thereof is independently controllable between the position of FIG. 4 in which recording is possible and the position of FIG. 5 in which the recording head is retracted from the recording medium, by each solenoid 34 being driven.

Description will now be made of the operation of the ink jet recording apparatus having the above-described construction. When the recording of one line is terminated, the discharge port surface 16 of the recording head 4 used for the recording is wiped and cleaned by the wiper member 30. Then, in order to remove any ink which may be mixed with other ink by this cleaning, a small amount of ink is discharged (idly discharged) from each recording head 4 at the position of the recess 31. Thereafter, the recording of the next line is started. In that case, the recording heads 4 of the colors which are not used for image formation are moved in the direction of arrow D (FIG. 5) by the corresponding solenoids 34 being driven, and are retracted away from the recording medium 1 as shown in FIG. 5. The presence or absence of the recording heads 4 not in use is discriminated for each line, and the recording heads 4 not in use are retracted by the aforedescribed control while that line is recorded. The recording head 4 moved from non-use positions to use is returned from the retracted position of FIG. 5 to the position of FIG. 4 in which recording is possible (in the direction of arrow E in FIG. 4).

On the other hand, ink mist by the ink discharge during the main scanning or paper powder, dust or the like from the recording medium 1 is liable to adhere to the discharge port surface 16 of the recording head 4 moved in the state in which recording is possible because the clearance F between the discharge port surface 16 and the recording medium 1 is small and therefore, after the termination of the recording of one line, the discharge port surface 16 is cleaned by the wiper member 30, and then the aforementioned idle discharge is effected at the position of the recess 31, whereafter the recording o the next line is started. In the shown example, the solenoid 34 is used as the driving means for retracting and returning each recording head 4, but as this driving means, use can be made of any driving means capable of retracting the recording heads 4, such as a system for driving a rack-pinion mechanism by a motor.

According to the embodiment described above, the recording heads 4 not used for recording are retracted before image formation and therefore, the adherence of paper powder and dust to the discharge port surfaces of these recording heads and the influence of ink mist can be eliminated and the deterioration of image quality by unsatisfactory discharge can be prevented. Also, cleaning is unnecessary for the retracted recording heads 4, and idle discharge for the removal of mixed inks is also unnecessary and therefore, the amount of consumed ink can be decreased.

Description will now be made of a second embodiment of the ink jet recording apparatus to which the present invention is applied. This second embodiment is designed such that, in addition to the construction and operation of the above-described embodiment, when the carriage 6 is reverted and moved (returned) to the recording start position, all recording heads 4 including the recording head 4 used for recording are retracted to the retracted position shown in FIG. 5 and that when the carriage 6 is reverted at the recording start position to start the recording of the next line, only the recording head 4 used for recording is returned to the position of FIG. 4 in which recording is possible. According to such second embodiment, an effect similar to that of the aforedescribed embodiment is obtained and besides, during the return movement of the carriage 6, the discharge port surfaces 16 of all recording heads 4 can be retracted away from the recording medium 1 and therefore, it becomes possible to further decrease the possibility of paper powder or dust from the recording medium 1 adhering to the discharge port surfaces 16.

Figure 6:
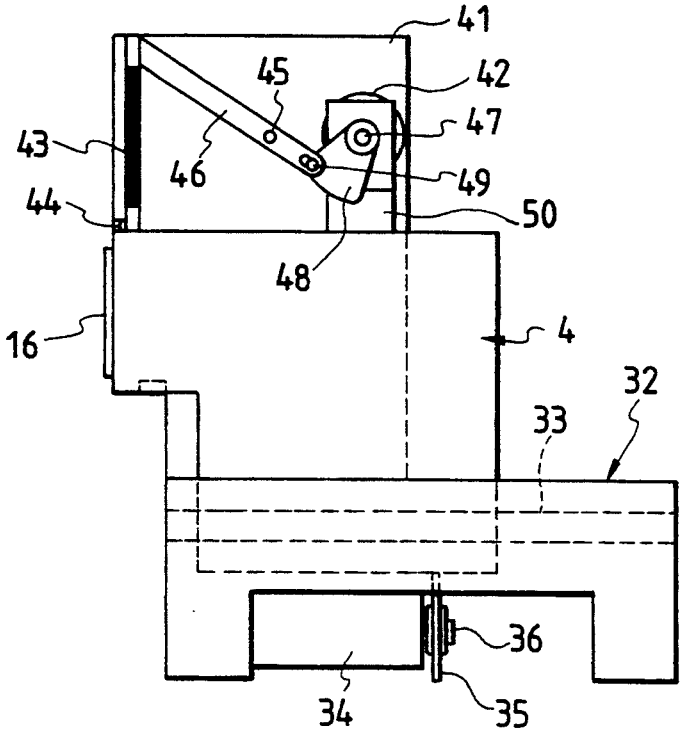
FIG. 6 is a side view showing the recording possible state of recording means and cap means in another embodiment of the ink jet recording apparatus to which the present invention is applied.
Figure 7:
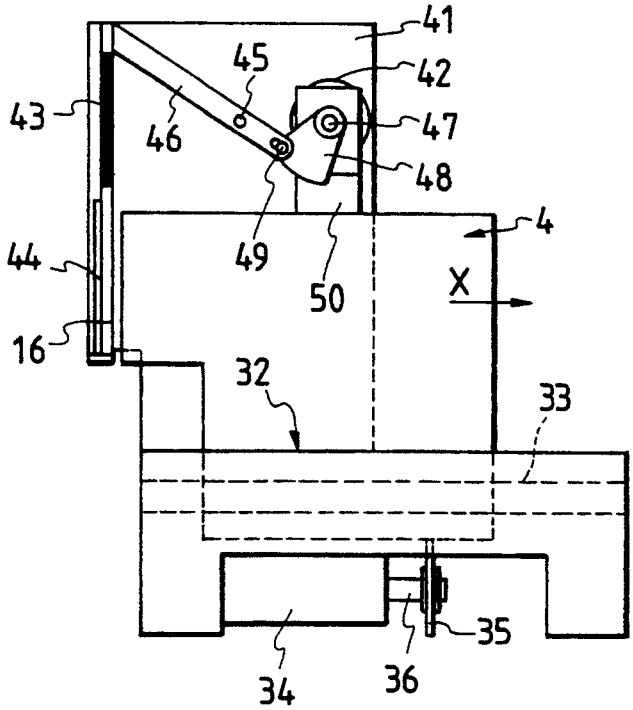
FIG. 7 is a side view showing a state in which the recording means have been retracted from the state of FIG. 6.
Figure 8:
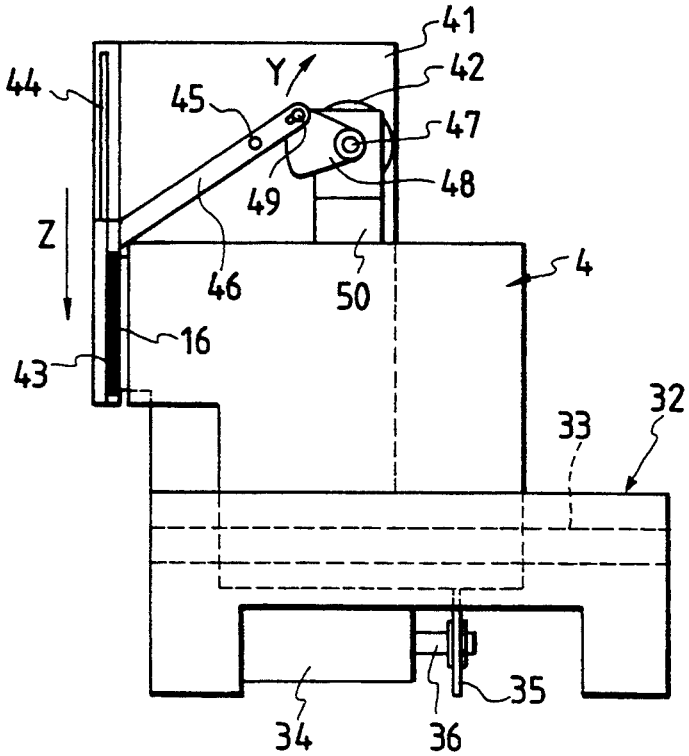
FIG. 8 is a side view showing a state in which, from the state of FIG. 7, the discharge port surface is further shielded by the cap means.

FIGS. 6 to 8 are side views showing the construction and operation of the essential portions of a third embodiment of the ink jet recording apparatus to which the present invention is applied. In this embodiment, in addition to the construction of the embodiments shown in FIGS. 1 to 5, independently operating cap means is provided for each recording means (recording head) 4. In FIGS. 6 to 8, a support plate 41 disposed upright along a side of each recording head 4 is provided integrally with the head housing 32 of each recording head 4, and design is made such that a cap member 43 for capping the discharge port surface 16 of each recording head 4 is operated by a motor 42 fixed to the support plate 41. This cap member 43 is held for vertical movement along a vertical guide groove 44 formed in the fore end portion of the support plate 41. Also, the intermediate portion of a pivotable arm 46 is pivotally support on a support shaft 45 provided on the support plate 41. This pivotable arm 46 is pivotable about the support shaft 45, and one end portion (the tip end portion) thereof is connected to the cap member 43.

The motor (oscillation motor) 42 is fixed to the support plate 41 through a mounting plate 50. The motor shaft 47 of this oscillation motor 42 has a lever 48 fixed thereto. The other end portion (base end portion) of the pivotable arm 46 is connected to the lever 48 through a pin 49 loosely fitted in a slot. Thus, the vertical position of the cap member 3 is controllable by the control of the rotation of the motor 42. The third embodiment of FIGS. 6–8 is one in which the above-described cap means is added to the construction of FIGS. 1–5, and is substantially similar in the construction of the other portions to the embodiments of FIGS. 1–5, and in this third embodiment, portions corresponding to those in the embodiments of FIGS. 1–5 are given similar reference characters and need not be described in detail.

FIG. 6 shows a state in which the recording head 4 is in a position in which recording is possible, FIG. 7 shows a state in which the recording head 4 is in a retracted position retracted from the recording medium, and FIG. 8 shows a state in which in the retracted position of FIG. 7, the discharge port surface 16 of the recording head 4 is capped by the cap member. That is, in the third embodiment, the recording head 4 not in use is first moved (retracted) in the direction of arrow X in FIG. 7 from the state of FIG. 6 by the solenoid 34 and further, the cad member 43 is moved in the direction of arrow Z in FIG. 8 by the oscillation motor 42, whereby the discharge port surface of that recording head 4 is capped. As the cap member 43, use can be made of any members of various materials and constructions which can shield the discharge port surface 16, for example, a member of the type in which an ink absorbing member or a rubber-like elastic member is brought into intimate contact with the discharge port surface, or a member of the type which is brought into intimate contact with the circumference of the discharge port surface 16 to hermetically seal the interior of the discharge ports.

According to the third embodiment described above with reference to FIGS. 6 - 8, in addition to the retraction of the recording head 4, the recording head 4 is capped and therefore, an effect similar to that of each of the aforedescribed embodiments is obtained and besides, the discharge port surface 16 of the retracted recording head 4 can be completely shielded from ink mist and paper powder, dust or the like, and it becomes possible to more reliably prevent these foreign materials from adhering to the discharge port surface 16 of each recording head 4.

According to the embodiments hitherto described, in an ink jet recording apparatus having a plurality of recording means 4 for recording with ink of different colors (dyes), those of the recording means 4 which are not used for recording are retracted away from the recording medium 1 before recording scan and further, as required, during the return movement of the carriage 6 for each one line, all recording heads 4 are retracted away from the recording medium 1 and furthermore, in addition, cap means capable of independently shielding the discharge part surface 16 of each recording means 4 is provided and therefore, the adherence of ink mist and paper powder, dust or the like to the discharge port surface 16 of each recording head 4 is greatly decreased, whereby an improved quality of recorded images and an improved life of the recording means can be achieved and moreover, the necessary frequency of idle discharge for preventing the different colors of the ink from being mixed with one another is decreased and thus, the amount of consumed ink can be saved.

In addition to the construction of each of the above-described embodiments, a fan (a blower) may be provided behind each recording head 4 so as to blow forward the ink mist created during recording and paper powder, dust or the like from the recording medium 1. In such case, if an airstream is applied from the gap between adjacent recording heads 4 toward the recording medium 1, there will be obtained a cooling effect for the recording heads 4. This will be effective for more effectively preventing the adherence of the ink mist and paper powder, dust or the like to the discharge port surface 16 of each recording head 4, particularly those of the recording heads 4 which are in the retracted position.

While in the above-described embodiments, the present invention has been described with respect to the case of a serial type recording apparatus in which use is made of two carriages 6 and 13 movable along the recording medium 1 and a plurality of recording means 4 and a plurality of ink tanks 12 are carried on these carriages, the present invention is equally applicable to a serial type recording apparatus in which use is made of a single carriage and a plurality of recording means and a plurality of ink tanks are carried on this carriage, and in such a case, a similar effect is obtained. Further, the present invention is not restricted to the above-described serial type recording apparatuses, but is also applicable to a line type recording apparatus using line recording means of a length corresponding to the whole or a part of the widthwise recording area of a recording medium, irrespective of the kind of the scanning system, and again in such a case, a similar effect can be achieved.

Also, as the recording means (recording head), use can be made of recording means of various constructions such as recording means of the interchangeable cartridge type in which a recording head and an ink tank are made integral with each other, or recording means of such structure that a recording head and an ink tank are discrete from each other and are coupled together as through a coupler and a tube. Further, the above embodiments have been described with respect to the case of a color recording apparatus provided with a plurality of recording means for recording in different colors, but the present invention is equally applicable to any recording apparatus having a plurality of recording means, such as a recording apparatus for harmonic recording which uses a plurality of recording means identical in color and differing in concentration, and in such a case as well, a similar effect can be achieved.

The present invention can be applied to any ink jet recording apparatus which uses recording means (recording heads) using, for example, electro-mechanical conversion members such as piezo-electric elements, and above all, brings about an excellent effect in an ink jet recording apparatus of the type which discharges ink by the utilization of heat energy, because according to such type, high density and high accuracy of recording can be achieved.

The typical construction and principle of such system may preferably be accomplished by the use of the basic principle disclosed, for example, in U.S. Pat. No. 4,723,129 and U.S. Pat. No. 4,740,796. This system is applicable to any of the so-called on demand type and continuous type-system, and particularly in the case of the on-demand type-system, it is effective because at least one driving signal corresponding to recording information and providing a rapid temperature rise exceeding nucleate boiling is applied to an electro-thermal conversion member disposed correspondingly to a sheet or a liquid path in which liquid ( ink ) is retained, whereby heat energy is generated in the electro-thermal conversion member and film boiling is caused on the heat acting surface of recording means ( recording head ) with a result that a bubble in the liquid (ink) corresponding at one to one to this driving signal can be formed.

By the growth and contraction of this bubble, the liquid (ink) is discharged through a discharge opening to thereby form at least one droplet. If this driving signal is of a pulse shape, the growth and contraction of the bubble appropriately take place on the spot and therefore the discharge of the liquid (ink) which is particularly excellent in responsiveness can be achieved, and this is more preferable. This driving signal of a pulse shape may suitably be a signal as described in U.S. Pat. No. 4,463,359 and U.S. Pat. No. 4,345,262. If the conditions described in U.S. Pat. No. 4,313,124 covering an invention relating to the temperature rise rate of said heat acting surface are adopted, more excellent recording can be accomplished.

As the construction of the recording head, besides the combined construction (straight liquid flow path or right-angled liquid flow path) of a discharge port, a liquid path and an electro-thermal conversion member as disclosed in the above-mentioned patents, the construction using U.S. Pat. No. 4,558,333 and U.S. Pat. No. 4,459,600 which disclose a construction in which a heat acting portion is disposed in a bent area is also covered by the present invention. In addition, the present invention is also effective if it adopts a construction based on Japanese Laid-Open Patent Application No. 59-123670 which discloses a construction in which a slit common to a plurality of electro-thermal conversion members provides the discharge portions of the electro-thermal conversion members or Japanese Laid-Open Patent Application No. 59-138461 which descloses a construction in which an opening for absorbing the pressure wave of heat energy corresponds to a discharge portion. That is, whatever form the recording head may assume, the present invention can accomplish recording reliably and efficiently.

Further, the present invention can also be effectively applied to a full line type recording head having a length corresponding to the maximum width of a recording medium on which a recording apparatus can record. Such a recording head may be of a construction which satisfies that length by a combination of a plurality of recording heads or a construction as a single recording head formed as a unit. In addition, even in the serial type recording apparatus as described above, the present invention is also effective in a case where use is made of recording heads fixed to the apparatus body, interchangeable chip type recording heads which become electrically connectable to the apparatus body or capable of being supplied with ink from the apparatus body by being mounted in the apparatus body or cartridge type recording heads each having an ink tank integrally provided in the recording head itself.

Also, the addition of recovery means, preliminary auxiliary means, etc. for recording heads provided as the construction of the recording apparatus of the present invention is preferable because it can better stabilize the effect of the present invention. Specifically mentioning these means, capping means, cleaning means and pressing or suction means for the recording heads, preheating means by an electrothermal conversion member or a heating element discrete therefrom or a combination of these, and a preliminary discharge mode for effecting discharge discrete from that for recording are also effective for accomplishing stable recording.

Also, the kinds or number of the recording heads carried on the carriage may be, for example, one corresponding to ink of a single color, or a plurality corresponding to a plurality of kinds of inks differing in recording color or concentration. That is, for example, the recording mode of the recording apparatus is not limited to a recording mode of only a main color such as black, but the recording head may be constructed as a unit or may be comprised of a combination of a plurality of heads, and the present invention is also very effective for an apparatus provided with at least one of a plurality of different colors or full color by mixed colors.

Furthermore, in the above-described embodiments of the present invention, the ink has been described as liquid, but may be ink which solidifies at room temperature or below and softens or liquefies at room temperature, or in the case of the ink jet system wherein it is usual to temperature-regulate ink itself within a range of 30° C. to 70° C. and temperature-control the ink so that the viscosity of the ink may be within a stable discharge range, ink which assumes its liquid phase when a recording signal used is imparted thereto. In addition, the temperature rise by heat energy is prevented by being positively used as the energy of the state change of ink from its solid state to its liquid state, or with a view to prevent the evaporation of ink, use is made of ink which solidifies when it is left as it is, and in any case, the present invention is also applicable to a case where use is made of ink having the nature of being liquefied only by heat energy, such as ink which is liquefied by heat energy being imparted thereto in conformity with a recording signal and is discharged as liquid, or ink which already begins to solidify at a point of time whereat it arrives at a recording medium.

The ink in such a case may be in the form as described in Japanese Laid-Open Patent Application No. 54-56847 or Japanese Laid-Open Patent Application No. 60-71260 wherein ink is retained as liquid or a solid in a porous sheet recess or a through-hole and is opposed to an electro-thermal conversion member. In the present invention, what is most effective for the above-described ink is that which executes the above-described film boiling system.

In addition, the form of the ink jet recording apparatus according to the present invention may be the form of an apparatus used as the image output terminal of an information processing instrument such as a computer, the form of a copying apparatus combined with a reader or the like, and further the form of a facsimile apparatus having the signal transmitting and receiving functions.

As is apparent from the foregoing description, according to the present invention, in an ink jet recording apparatus provided with a plurality of recording means for discharging inks to a recording medium to thereby effect recording, each of the recording means is designed to be independently retractable and therefore, there is provided an ink jet recording apparatus in which the adherence of the ink and paper powder or the like to the discharge port surface of each recording head can be prevented and the influence of the wiper member or the like upon the discharge port surface can be eliminated and moreover, the amount of ink consumed for idle discharge can be saved.

Also, according to the present invention, there is adopted, in addition to the construction described just above, a construction in which those of the plurality of recording means which are not used for recording are retracted, a construction in which the recording means are retracted during sub-scanning, a construction in which the recording means are carried on a carriage reciprocally movable along a recording medium and the recording means are retracted during the return movement of the carriage, a construction in which all recording means are retracted during sub-scanning, or a construction in which cap means capable of capping the plurality of recording means independently of one another is provided and therefore, there is provided an ink jet recording apparatus in which the adherence of the ink and paper powder or the like to the discharge port surface of each recording head can be prevented more efficiently and the influence of the wiper member or the like upon the discharge port surface can be eliminated and moreover, the amount of ink consumed for idle discharge can be saved.

What is claimed is:

1. An ink jet recording apparatus for performing color recording by depositing a plurality of inks on a recording medium, said apparatus comprising:

a plurality of recording means, provided apart from the recording medium by a predetermined distance, for discharging the ink to thereby effect recording;

a carriage for mounting said plurality of recording means for scanning; and a moving means for allowing said plurality of recording means to independently move on said carriage from a position apart from the recording medium by the predetermined distance to a retracted position retracted from a region where ink mist associated with said recording means exists, wherein said moving means retracts only those of said plurality of recording means which are not used in response to an input recording signal.

2. An ink jet recording apparatus according to claim 1, wherein each of said plurality of recording means is moved to said retracted position when said carriage returns to a recording start position after recording for one line.

3. An ink jet recording apparatus according to claim 1, wherein each of said plurality of recording means has a cap member for covering a surface for discharging ink and said cap member covers said surface of each of those of said recording means not used when recording.

4. An ink jet recording apparatus for performing color recording by depositing a plurality of inks on a recording medium, said apparatus comprising:

a plurality of recording means, provided apart from the recording medium by a predetermined distance, for discharging the ink to thereby effect recording;

a carriage for mounting said plurality of recording means for scanning;

a moving means for allowing said plurality of recording means to independently move on said carriage from a position apart from the recording medium by the predetermined distance to a retracted position retracted from a region where ink mist associated with said recording means exists, said moving means retracting only those of said plurality of recording means which are not used in response to an input recording signal; and a cap member for covering an ink discharge surface of said recording head at said retracted position.

5. An ink jet recording apparatus according to claim 4, wherein each of said plurality of recording means is moved to said retracted position when said carriage returns to a recording start position after recording for one line.

6. An ink jet apparatus according to claim 4, wherein each of said recording means is provided with an electro-thermal conversion element for generating heat energy utilized to discharge the ink.

* * * * *

UNITED STATES PATENT AND TRADEMARK OFFICE

CERTIFICATE OF CORRECTION

PATENT NO. : 5,363,132

DATED : November 8, 1994

INVENTOR(S) : Masatoshi IKKATAI

It is certified that error appears in the above-indentified patent and that said Letters Patent is hereby corrected as shown below:

COLUMN 1:

Line 35, "of" should be deleted.

COLUMN 2:

Line 56, "ink are" should read --ink droplets are--.

COLUMN 3:

Line 58, "of/the" should read --of the--;
Line 68, "is" should read --in--.

COLUMN 4:

Line 24, "3" should be deleted;
Line 65, "heads) 4" should read --head) 4--.

COLUMN 6:

Line 11, "a-wiper" should read --a wiper--.

UNITED STATES PATENT AND TRADEMARK OFFICE

CERTIFICATE OF CORRECTION

PATENT NO. : 5,363,132 Page 2 of 2

DATED : November 8, 1994

INVENTOR(S) : Masatoshi IKKATAI

It is certified that error appears in the above-indentified patent and that said Letters Patent is hereby corrected as shown below:

COLUMN 7:

Line 25, "(solenoid) 35" should read --(solenoid) 34--;

Line 67, "o" should read --of--.

COLUMN 9:

Line 16, "cad" should read --cap--.

Signed and Sealed this

Twenty-eight Day of March, 1995

Bruce Lehman

*Attest:*

BRUCE LEHMAN

*Attesting Officer*

*Commissioner of Patents and Trademarks*